US005907934A

United States Patent [19]

Austin

[11] Patent Number: 5,907,934

[45] Date of Patent: Jun. 1, 1999

[54] INTERFACING FLOOR TILE

[76] Inventor: John Austin, 88 Grace Terrace, Pasadena, Calif. 91105

[21] Appl. No.: 08/971,233

[22] Filed: Nov. 15, 1997

Related U.S. Application Data

[63] Continuation-in-part of application No. 08/935,357, Sep. 22, 1997.

[51] Int. Cl.[6] ..... E04F 11/16

[52] U.S. Cl. ..... 52/177; 52/179; 52/180; 52/311.2; 52/385; 52/387; 52/590.2; 52/591.2; 52/591.5; 52/592.1; 404/34; 404/35

[58] Field of Search ..... 52/177, 179, 180, 52/311.2, 590.1, 590.2, 591.1–591.5, 589.1, 592.1, 592.2, 384, 387, 506.01; 404/34, 35, 36, 41, 42

[56] References Cited

U.S. PATENT DOCUMENTS

| | | | |
|---|---|---|---|
| 708,470 | 9/1902 | Flood . | |
| 1,361,501 | 12/1920 | Schepmoes . | |
| 3,909,996 | 10/1975 | Ettlinger, Jr. et al. | 52/177 |
| 4,308,698 | 1/1982 | Fleishman | 52/81 |
| 4,436,779 | 3/1984 | Menconi et al. | 428/169 |
| 4,468,910 | 9/1984 | Morrison | 52/591 |
| 4,497,858 | 2/1985 | Dupont . | |
| 4,550,543 | 11/1985 | Valenzano . | |
| 4,993,984 | 2/1991 | Matarese | 446/118 |
| 5,137,392 | 8/1992 | McCoy . | |
| 5,173,003 | 12/1992 | Hair . | |
| 5,186,574 | 2/1993 | Tavares . | |
| 5,230,584 | 7/1993 | Grossman . | |
| 5,280,691 | 1/1994 | Rundmund | 52/513 |
| 5,466,089 | 11/1995 | Jurik . | |
| 5,628,154 | 5/1997 | Gavette | 52/81.4 |
| 5,630,304 | 5/1997 | Austin . | |
| 5,791,114 | 8/1998 | Mandel | 52/591.3 |

OTHER PUBLICATIONS

Industrial Products, Inc., Brochure, 2pages for "Checkers" cable and Hose Protection system.No date.

Steelwood Industries, Inc., Brochure, 4pages for "Steelwood Steel Tile Anchor Plate".1991.

*Primary Examiner*—Carl D. Friedman
*Assistant Examiner*—Yvonne Horton-Richardson
*Attorney, Agent, or Firm*—John F. Sicotte

[57] ABSTRACT

An interfacing floor tile in the form a right triangle with two adjacent sides of equal length is provided with elongated third side opposite the right triangle. Each side is formed with a row of female cavities located adjacent the sides and positioned to mate with a corresponding male connecting members of a neighboring tiles. Additionally, each of the adjacent sides is integrally formed with an edge which slopes downward to a male interlocking strip which extends outwardly in order to mate with female cavities of neighboring tiles. Alternatively, each of the adjacent sides may be formed with vertical edges which rise from the interlocking strip to the surface of the tile. In another embodiment the female cavities are omitted from the elongated side which has a vertical edge and the adjacent sides may have either sloping or vertical edges.

9 Claims, 4 Drawing Sheets

INTERFACING FLOOR TILE

BACKGROUND OF THE INVENTION

This invention is a continuation-in-part of my prior copending application, ser. no. 08/935,357, filed Sep. 22, 1997, now pending.

DESCRIPTION OF THE RELATED ART

It is becoming more common for workplace areas to be designed with a variety of room shapes with walls which may be at some acute angle to the remainder of the room. Also hallways today may enter a room at an angle instead of being perpendicular to the room. This situation is generally being caused by the desire to have workplaces that are less formidable and rigid. Architects have been designing work areas that seem more friendly and creative by changing the perimeter of a room and access to work areas. It is also becoming commonplace in some work areas to install wall to wall flooring in the form of square interlocking rubber tiles. Because of ergonomics, safety, static electricity or style the demand for this type of flooring is increasing. In factories or businesses special types of floor tiles are being used in many areas such as manufacturing and assembly areas. Generally, the tiles are three foot square are constructed of rubber or vinyl materials. Such tiles are formed female interlocking cavities along two adjacent edges and male interlocking strips along the opposites edges. The tiles are joined together to form a large mat which will cover the entire floor area of room.

The combination of modern designs for work areas and the desire or need to have flooring constructed from interlocking square tiles has created a new problem. All flooring systems which involve the use of square tiles will be inherently rigid in their design. The tiles will naturally form a rectilinear grid that will extend from wall to wall. The problem arises will the perimeter of a room is parallel or perpendicular to the grid. If a wall or hall is design to intersect the grid at a 45 degree angle there is a need to modify the shape of the grid to achieve complete coverage. The common solution today is for the installer of the tiles to simply cut away with a knife the excess portion of a tile along the base of the wall at the point where it intersects the grid. Although this an effective and simple solution it has some drawbacks. When the excess portion of the tile is cut off it leaves a raw and unseemly jagged edge. It is also impossible for an installer to trim tile after tile without producing tiles which are inconsistent in appearance. There will always be some slight variation in the appearance of the trimmed edges. In the past the style was to install wall to wall carpet. After the installer trimmed away excess carpet the trimmed edge could be easily hidden at the baseboard. Modern ergonomic tiles are not so forgiving. Oftentimes their surfaces are designed with domes to reduce fatigue. Anytime an installer must cut the excess portion away from a tile he must cut across numerous domes, leaving a finished edge with an unacceptable appearance. The cutaway edge also has the problem that it is no longer able to seal out dirt and moisture. In many situations moisture will defeat the safety and anti static features of the tiles.

Another problem when using the traditional technique of simply away excess portions of square tiles is in the areas where hallways intersect the rectilinear grid of a room mat. The installer of a runner mat in a hallway, when encountering a room mat, would simply cut away the excess portions of the runner mat and the room tiles. Then he would simply glue the remainder of the room tiles to the remainder of the runner mat. While this is a simple solution it is unacceptable for several reasons. It is impossible to mate the room tile and the runner mat together and achieve an acceptable seam. It is also impossible to assure that the seam will not be vulnerable to infiltration by dirt or water. It also produces a potential safety hazard should the glued seam fail. Lastly, it is practically impossible for the installer to make such cuts across domed tiles and have the remaining portions from the separate tile and mat align themselves perfectly to form whole domes.

It is therefore desirable to provide for a new and unique interfacing floor tile, for use in the construction of wall to wall rectilinear grid mat formed from square interlocking tiles. The invention herein permits the construction of a room size floor covering of such tiles by interlocking with the tiles and then forming a finished edge along the perimeter of the mat. It is also desirable to provide a unique tiles which will interface between a room tile and a runner mat without destroying the integrity of either the mat or the tile. It is further desirable to provide an interfacing tile that offers the installer a selection of installation positions when a runner mat intersects room.

SUMMARY OF THE PRESENT INVENTION

The problems noted above are overcome by the use of a interfacing floor tile of the instant invention which can be interlocked with the edge of a square tile which is part of rectilinear grid to form a flooring edge which will then run at a 45 degree angle to the original floor grid. This desired result is achieved by providing a triangular shaped floor tile with a body portion having one right angle corner which is formed by two adjacent sides of equal length and a third side opposite the right angle corner. In the preferred embodiment all three sides include a plurality of female cavities integrally formed in the underside of the tile and which extend along the length of each of the sides. Also the two adjacent sides of the preferred embodiment are formed with an integrally formed with an outwardly extending interlocking strip. Each of these interlocking strips supports a row of male interlocking members which are located to mate with a corresponding female cavity of a compatible square floor tile.

According to another feature of the invention, some or all of the edges of the interfacing tile may be rounded or beveled to provide a finished safety edge. The first and second adjacent sides may be formed with an edge which slopes from the top surface of the tile down to the top of the integrally formed interlocking strip at the point where it extends outwardly from the tile. Such strips when not used for interlocking purposes may be remove by severing them from the tile to produce a finished edge. The procedure is described in my U.S. Pat. No. 5,630,304, issued May 20, 1997.

According to a further feature of the invention, the third side, that is the side opposite the right angle corner of the tile may be constructed in the form of a vertical edge in order to make flush contact with walls or baseboards or other flooring surfaces at the outer perimeter of a room.

It is an object of this invention to provide a right angle floor tile that can be used to interface between square floor tiles, forming a rectilinear grid and perimeter wall which intersect the grid at an angle of 45 degrees.

It is a further object of this invention to provide an interfacing floor tile that can be used to interface between a grid formed of square tiles and a runner mat formed of interlocking tiles which intersects the grid at an angle of 45 degrees.

It is a further object of this invention to provide an interfacing floor tile with an interfacing edge that permits a range of interlocking positions which are freely selectable by an installer.

It is a further object of this invention to provide a right angle tile which is adaptable to be used with square floor tiles having beveled edges and interlocking strips.

Other objects and features of this invention will be pointed out in the following description and claims and illustrated in the accompanying drawings, which disclose by way of example, the principles of the invention, and the best mode which has been contemplated for carrying them out.

BRIEF DESCRIPTION OF THE DRAWINGS

In the drawings similar elements are given similar reference characters.

DETAILED DESCRIPTION OF THE INVENTION

Figure 1:
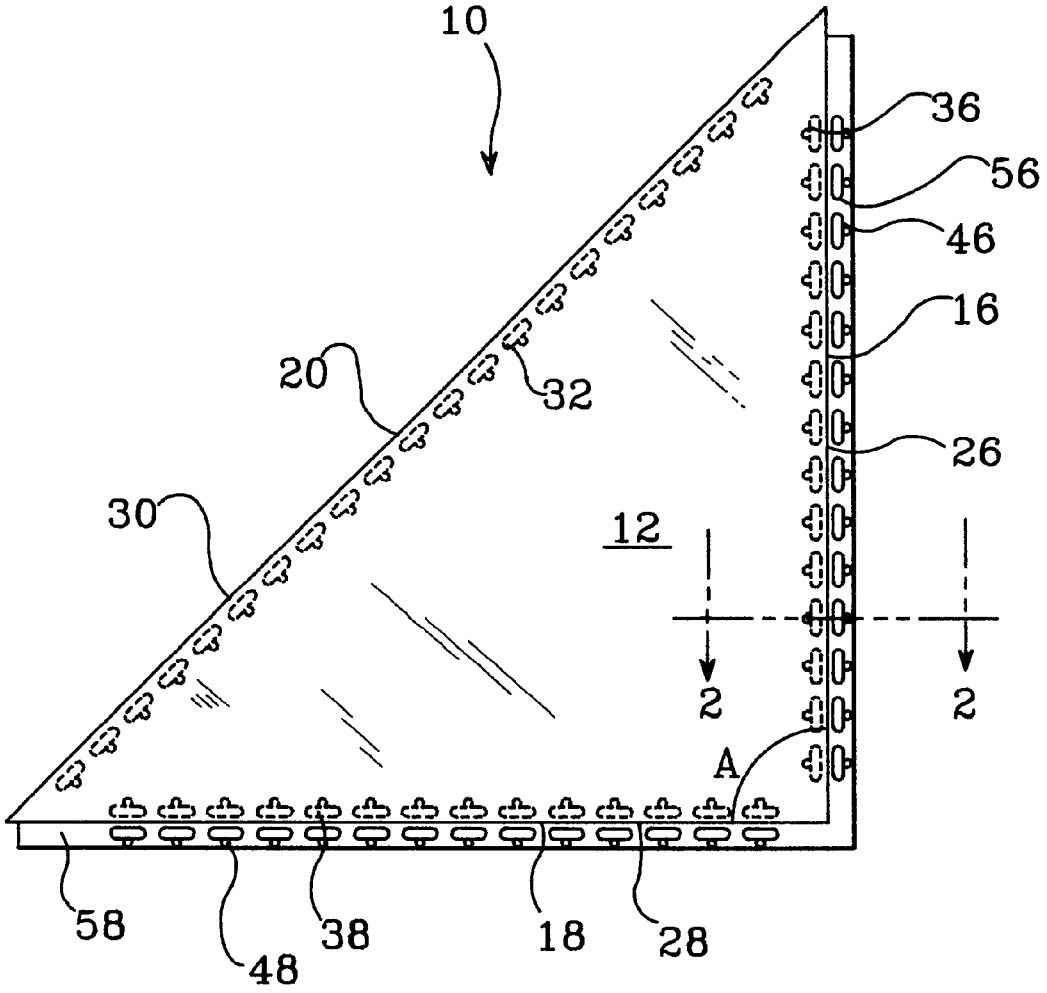
FIG. 1 is a top plan view of an interfacing floor tile constructed in accordance with the concepts of the invention.
Figure 2:
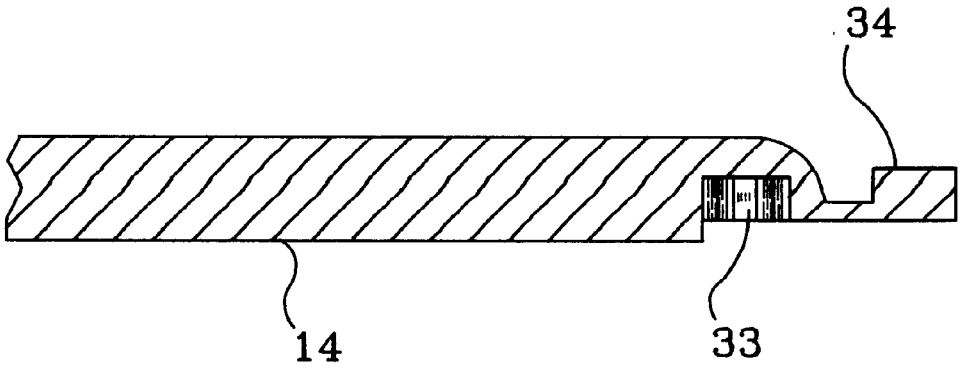
FIG. 2 is a side elevational view of the intersecting floor tile, in cross-section, taken along the line 2—2 in FIG. 1.

Referring now to FIGS. 1 and 2 of the drawings the right angle or interfacing floor tile 10 constructed in accordance with the concepts of the invention. Tile 10 is shown having a top surface 12 and a bottom surface 14 and a right angular shape defined by adjacent sides 16 and 18 which are of equal length and opposite side 20. Adjacent sides 16 and 18 diverge at an internal angle A, which is equal to 90 degrees. In the preferred embodiment, each of the sides 16, 18, 20 have edges 26, 28 and 30, respectively, which been formed with a rounded or beveled surface. It should also be noted that in this preferred embodiment of the invention that both adjacent sides 16 and 18 have been formed with a set of female interlocks along each edge. In FIG. 1 it can be seen that side 16 has a plurality of female cavities 36 (shown in phantom) integrally formed within bottom surface 14 for nearly the entire length of side 16. A cross section of a single female cavity may be seen in FIG. 2 at reference numeral 33. In addition to female cavities 36 side 16 also has an equal number of male interlocks 46 supported by an interlock strip 56 which has been integrally formed with edge 26. A male interlock and the supporting interlock strip is illustrated in cross section in FIG. 2 at reference numeral 34. On the other side of internal angle A is adjacent side 18 which has edge 28. Edge 28 is identical to edge 26 in that it contains the same beveled edge with integrally formed female cavities 38 and male interlocks 48 supported by an interlock strip 58.

At the side opposite internal angle A of tile 10 is side 20. In the preferred embodiment the opposite side 20 has a rounded or beveled edge 30 which is equal to the length of edge 20. Adjacent to side 20 are a row of female cavities 32, shown in phantom, formed in the bottom surface 14. In use rounded edge 30 serves to provide an interfacing surface along a baseboard or wall without any modification which will denigrate its appearance. It also provides a finished edge which will inhibit the infiltration of dirt and moisture. This is especially important in factory settings where there may be debris from machining operations or in areas where there may be fluids used in production. Maintenance is also improved in that foreign materials may be readily vacuumed away or removed.

Figure 3:
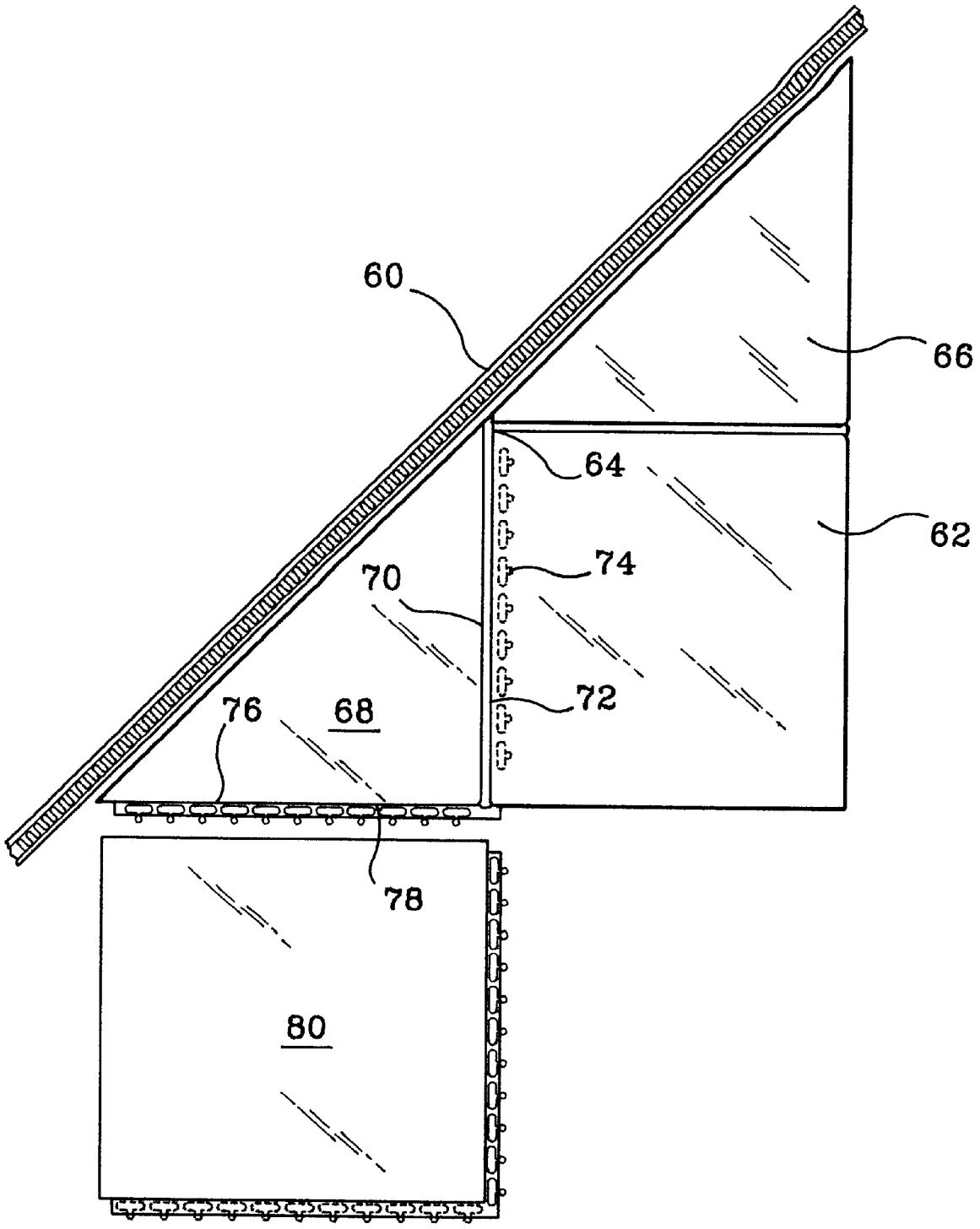
FIG. 3 is a top plan view of an interfacing floor tile shown being used to interface between a grid formed of square tiles and a wall surface.

Typically, the preferred embodiment of the present invention will be used to interface between a room sized mat constructed of interlocking tiles which are 36 inches on a side. When assembled the tiles form a rectilinear grid covering nearly the entire room. When the grid reaches the perimeter of the room and encounters a wall which intersects the grid at a 45 degree angle, the grid must be modified. In FIG. 3 wall 60 is shown intersecting a mat grid, represented by tile 62 at point 64. The space between tile 62 and wall 60 is shown as being filled by interfacing tile 66 which is interlocked with tile 62. Further down the wall is interfacing tile 68 shown as it is partially installed. Edge 70 of interfacing tile 68 has been interlocked with edge 72 of tile 62. The engaged male and female interlocks are shown in phantom at 74. Adjacent edge 76 of interfacing tile 68 is about to be interlocked along its edge 78 with another tile 80 which is part of the rectilinear mat grid. In should be noted that in this portion of an installation along a wall, female cavities 32 shown in FIG. 1 are not used.

Figure 4:
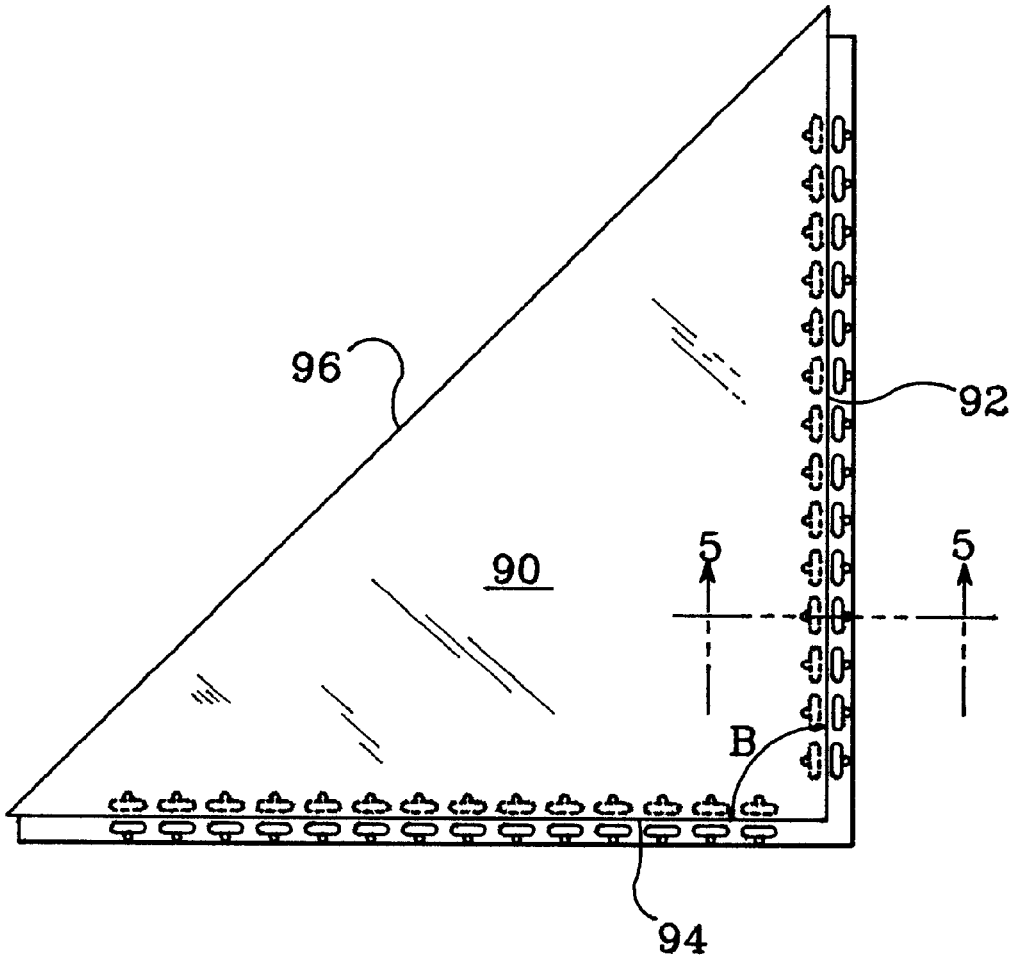
FIG. 4 is a top plan view of an alternative embodiment of the interfacing floor tile constructed in accordance with this invention.
Figure 5:
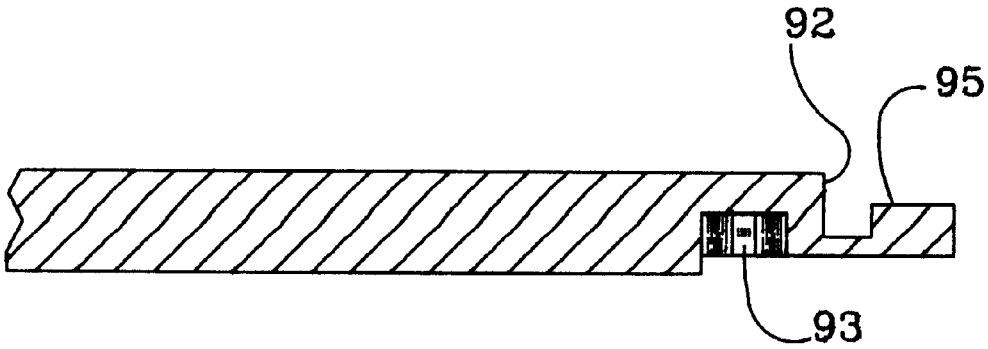
FIG. 5 is a side elevational view of the intersecting floor tile, in cross-section, taken along the line 5—5 in FIG. 4.

In FIG. 4 an alternative embodiment of the invention is shown. Interfacing tile 90 has adjacent edges 92 and 94 which are not rounded, but vertical. A cross section of edge 92 and single female cavity may be seen in FIG. 5 at reference numeral 93 adjacent to male interlock 95. Alternative embodiment 90 also differs in that the side 96 which is opposite the right angle B does not contain any female cavities. In some applications, such as along walls, female cavities would not be needed. In other applications, such as areas where the interface mat may be required to make a transition from the mat to carpeting, a solid interfacing edge is desirable. Edge 96 would present an edge which is more durable to traffic. Where more safety is required edge 96 may have a rounded or beveled form such as edge 30 in FIG. 1.

Figure 6:
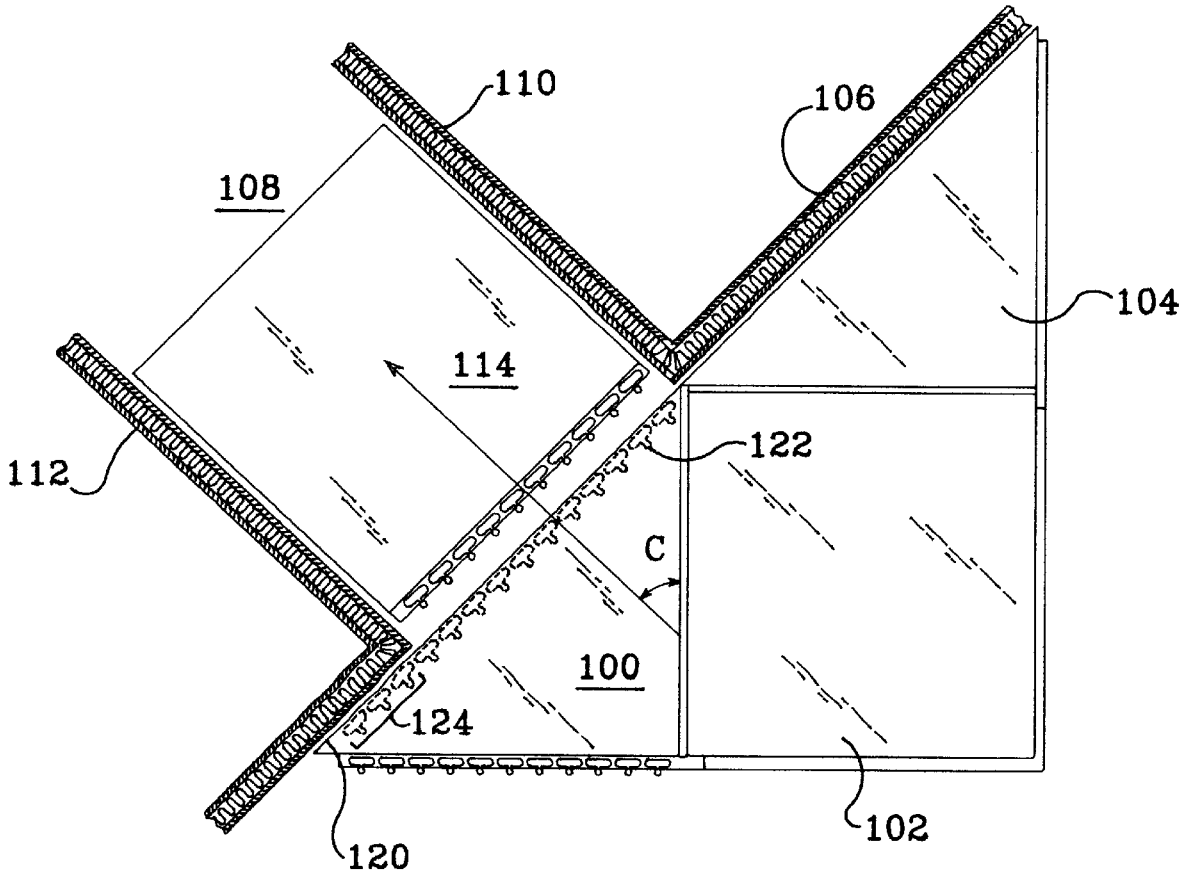
FIG. 6 is a top plan view of an the preferred embodiment of the invention as used as an interface with a hallway runner.

Turning now to FIG. 6 there is shown another application of the preferred embodiment. Interfacing tile 100 is the same tile described as tile 12 in FIG. 1. For purposes of this illustration only certain elements of interfacing tile 100 will be described. In certain applications, such as when the rectilinear grid composed of square tiles, a room sized mat intersects a hallway at an angle of 45 degrees. This is represented by angle C in FIG. 6. Since the point at which a hallway intersects a rectilinear grid cannot be easily accommodated when planning a room sized mat, it is beneficial to have an interfacing tiles with multiple interlocking points. In FIG. 6 interfacing tile 100 is shown as being interlocked with square grid tile 102. Tile 102 is also shown as being interlocked with interface tile 1O4, thus forming completion of the grid to wall 106. Hallway 108, formed by walls 110 and 112 intersect tile 100 at angle C. Within hallway 108 is the next tile 114 to be interlocked with the mat grid by way of interface tile 100. Tile 114 is the same tile of square tile, 36 inches by 36 inches, which was used to form the body of the rectilinear grid. Along edge 120 of tile 100 the a multitude of female cavities 122 by which tile 100 will be interlocked with tile 114. The design of the preferred embodiment is such that there will always be a surplus of female cavities, allowing for variations of the point of intersection with the mat grid. In this example, interfacing tile 100 would have approximately 14 extra female cavities, indicated by reference numeral 124, available for attachment of tile 114. This means that tile 114 could vary its intersect point with the grid within a range of 14 inches and still retain a perfectly complete interlock with the mat grid.

WHEREAS, a preferred embodiment and an alternative embodiment of the invention has been illustrated and described in detail, it will be apparent that various changes may be made in the disclosed embodiments without departing from the spirit of the invention.

What is claimed is:

1. An interfacing floor tile for a rectilinear flooring system, comprising:

a. a top surface, a parallel bottom surface, and three side surfaces forming a right triangle;

b. said three side surfaces being composed of a first side surface and a second side surface forming the adjacent sides of said right triangle and a third side surface forming the side opposite to said right triangle;

c. said first side surface and said second side surface being integrally formed with an outwardly extending interlocking strip having a multitude of male interlocking members; and, d. said first side surface and said second side surface and said third side surface being formed with a multitude of female cavities in said bottom surface and located in a row adjacent to said side surfaces and said cavities being positioned to mate with male connecting members of any like tile.

2. The interfacing floor tile in claim 1, wherein said first and said second side surfaces have downwardly sloping edges, inclining outwardly from said top surface to said interlocking strips.

3. The interfacing floor tile in claim 1, wherein said first side surface and said second side surface are formed as a vertical edge, rising upwardly from said interlocking strip to said top surface.

4. The interfacing floor tile in claim 1, wherein said first side surface and said second side surface further comprise downwardly sloping edges, inclining outwardly from said top surface to said interlocking strip and said third side surface comprises a vertical edge.

5. The interfacing floor tile in claim 1, wherein said first side surface and said second side surface further comprise downwardly sloping edges, inclining outwardly from said top surface to said interlocking strip and said third side surface comprises downwardly sloping edges, inclining outwardly from said top surface to said bottom surface.

6. An interfacing floor tile for a rectilinear flooring system, comprising:

a. a top surface, a parallel bottom surface, and three side surfaces forming a right triangle;

b. said three side surfaces being composed of a first side surface and a second side surface forming a adjacent sides of said right triangle and a third side surface forming the side opposite to said right triangle;

c. said first side surface and said second side surface being integrally formed with an outwardly extending interlocking strip having a multitude of male interlocking members; and, d. said first side surface and said second side surface being formed with a multitude of female cavities in said bottom surface and located in a row adjacent to said first side surface and said second side surface and said cavities being positioned to mate with male connecting members of any like tile.

7. The interfacing floor tile in claim 6, wherein said first and said second side surfaces have downwardly sloping edges, inclining outwardly from said top surface to said interlocking strips.

8. The interfacing floor tile in claim 6, wherein said first side surface and said second side surface are formed as vertical edges, rising upwardly from said interlocking strips to said top surface.

9. The interfacing floor tile in claim 6, wherein said first side surface and said second side surface further comprise a downwardly sloping edges, inclining outwardly from said top surface to said interlocking strips and said third side surface comprises a vertical edge.

* * * * *